US005934718A

United States Patent [19]

La Valle

[11] Patent Number: 5,934,718

[45] Date of Patent: Aug. 10, 1999

[54] ENTERTAINMENT SYSTEM CABINET LOCKING DEVICE

[76] Inventor: Timothy J. La Valle, 2603 Britain Way, St. Charles, Mo. 63304

[21] Appl. No.: 09/007,416

[22] Filed: Jan. 15, 1998

[51] Int. Cl.[6] ..... E05C 19/18

[52] U.S. Cl. ..... 292/289; 292/288; 292/DIG. 65; 292/1

[58] Field of Search ..... 292/288, 289, 292/145, 137, 300, 162, 156, DIG. 21, 1, 251.1, DIG. 65; 49/394

[56] References Cited

U.S. PATENT DOCUMENTS

| | | | |
|---|---|---|---|
| 1,246,585 | 11/1917 | Geraerdts | 292/258 |
| 1,627,476 | 5/1927 | Barrett | 292/1 |
| 2,954,253 | 9/1960 | Teetor | 292/251.5 |
| 3,403,933 | 10/1968 | Rossow | 292/251.5 |
| 3,623,268 | 11/1971 | Zepf | 292/145 |
| 4,372,592 | 2/1983 | Beese | 292/288 |
| 4,915,430 | 4/1990 | Vitale | 292/288 X |

FOREIGN PATENT DOCUMENTS

| | | | |
|---|---|---|---|
| 300539 | 3/1928 | United Kingdom | 292/145 |

*Primary Examiner*—Darnell M. Boucher

[57] ABSTRACT

An entertainment cabinet door locking apparatus is provided including a front extent having a planar configuration with a front face, a rear face, and a periphery formed therebetween. Also included is a rear extent including at least one plate coupled at a top edge thereof to a top edge of the front extent in parallel relationship therewith.

4 Claims, 2 Drawing Sheets

ENTERTAINMENT SYSTEM CABINET LOCKING DEVICE

BACKGROUND OF THE INVENTION

1. Field of the Invention

The present invention relates to locking devices and more particularly pertains to a new entertainment system cabinet locking device for preventing a small child or baby from opening doors of an entertainment system cabinet.

2. Description of the Prior Art

The use of locking devices is known in the prior art. More specifically, locking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art locking devices include U.S. Pat. No. 4,819,463; U.S. Pat. No. 4,313,320; U.S. Pat. Des. 350,985; U.S. Pat. No. 4,715,628; U.S. Pat. No. 4,471,628; U.S. Pat. No. 4,4711,980; and U.S. Pat. No. 4,279,454.

In these respects, the entertainment system cabinet locking device according to the present invention substantially departs from the conventional concepts and designs of the prior art, and in so doing provides an apparatus primarily developed for the purpose of preventing a small child or baby from opening doors of an entertainment system cabinet.

SUMMARY OF THE INVENTION

In view of the foregoing disadvantages inherent in the known types of locking devices now present in the prior art, the present invention provides a new entertainment system cabinet locking device construction wherein the same can be utilized for preventing a small child or baby from opening doors of an entertainment system cabinet.

The general purpose of the present invention, which will be described subsequently in greater detail, is to provide a new entertainment system cabinet locking device apparatus and method which has many of the advantages of the locking devices mentioned heretofore and many novel features that result in a new entertainment system cabinet locking device which is not anticipated, rendered obvious, suggested, or even implied by any of the prior art locking devices, either alone or in any combination thereof.

To attain this, the present invention generally comprises a front extent having a planar rectangular configuration. The front extent is equipped with a front face, a rear face, and a periphery formed therebetween. The periphery is defined by a long top and bottom edge and a pair of short side edges. Also included is a rear extent having a pair of plates each with a planar square configuration. A periphery of each plate is defined by a top edge, a bottom edge and a pair of side edges formed therebetween. An area of each plate of the rear extent is about ⅓ that of the front extent. The plates of the rear extent are coupled at the top edges thereof to the top edge of the front extent on opposite sides of the front extent and in parallel relationship therewith. As such, a space is situated therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new entertainment system cabinet locking device apparatus and method which has many of the advantages of the locking devices mentioned heretofore and many novel features that result in a new entertainment system cabinet locking device which is not anticipated, rendered obvious, suggested, or even implied by any of the prior art locking devices, either alone or in any combination thereof.

It is another object of the present invention to provide a new entertainment system cabinet locking device which may be easily and efficiently manufactured and marketed.

It is a further object of the present invention to provide a new entertainment system cabinet locking device which is of a durable and reliable construction.

An even further object of the present invention is to provide a new entertainment system cabinet locking device which is susceptible of a low cost of manufacture with regard to both materials and labor, and which accordingly is then susceptible of low prices of sale to the consuming public, thereby making such entertainment system cabinet locking device economically available to the buying public.

Still yet another object of the present invention is to provide a new entertainment system cabinet locking device which provides in the apparatuses and methods of the prior art some of the advantages thereof, while simultaneously overcoming some of the disadvantages normally associated therewith.

Still another object of the present invention is to provide a new entertainment system cabinet locking device for preventing a small child or baby from opening doors of an entertainment system cabinet.

Even still another object of the present invention is to provide a new entertainment system cabinet locking device that includes a front extent having a planar configuration with a front face, a rear face, and a periphery formed therebetween. Also included is a rear extent including at least one plate coupled at a top edge thereof to a top edge of the front extent in parallel relationship therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
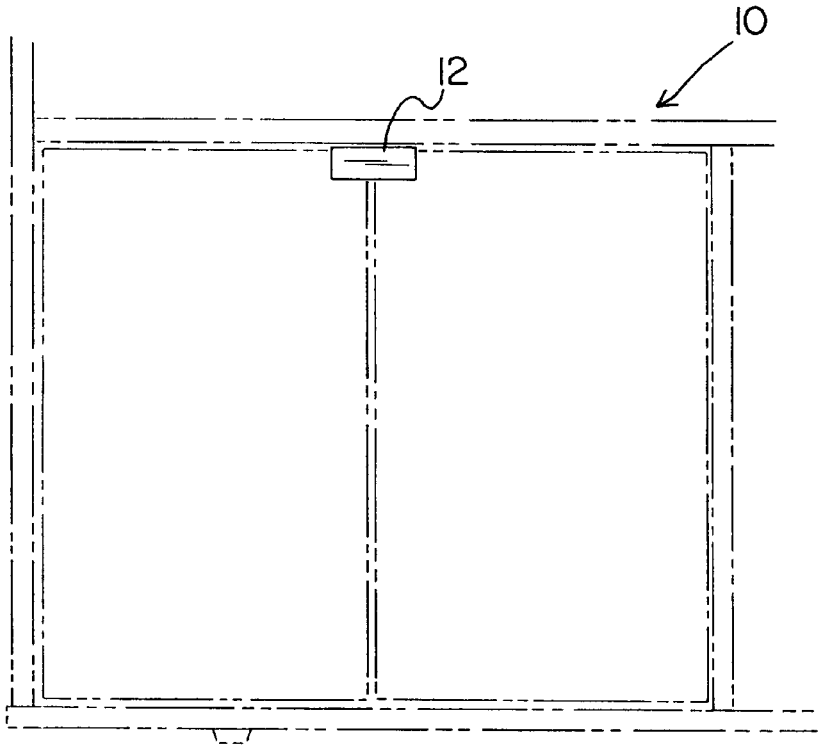
FIG. 1 is a front view of a new entertainment system cabinet locking device according to the present invention.
Figure 2:
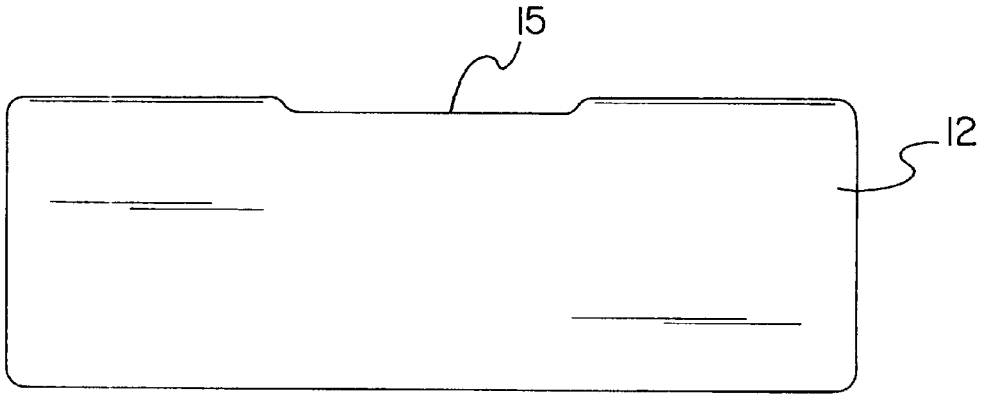
FIG. 2 is a close-up front view of the present invention.
Figure 3:
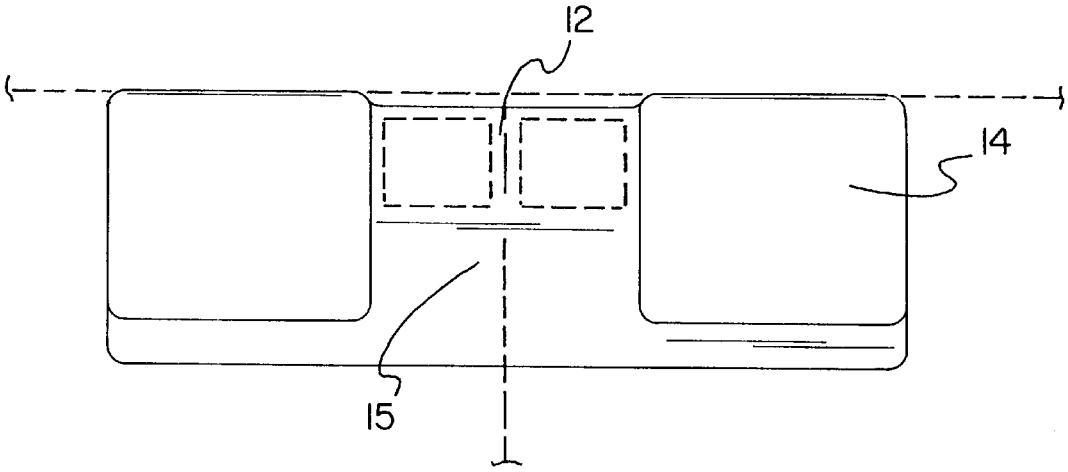
FIG. 3 is a rear view of the present invention.

With reference now to the drawings, and in particular to FIGS. 1 through 4 thereof, a new entertainment system cabinet locking device embodying the principles and concepts of the present invention and generally designated by the reference numeral 10 will be described.

The present invention, designated as numeral 10, includes a front extent 12 having a planar rectangular configuration. The front extent is equipped with a front face, a rear face, and a periphery formed therebetween. The periphery is defined by a long top and bottom edge and a pair of short side edges.

Also included is a rear extent 14 having a pair of plates each with a planar square configuration. A periphery of each plate is defined by a top edge, a bottom edge and a pair of side edges formed therebetween. An area of each plate of the rear extent is about ⅓ that of the front extent. The plates of the rear extent are coupled at the top edges thereof to the top edge of the front extent on opposite sides of the front extent and in parallel relationship therewith. As such, a space 15 is situated therebetween.

Figure 4:
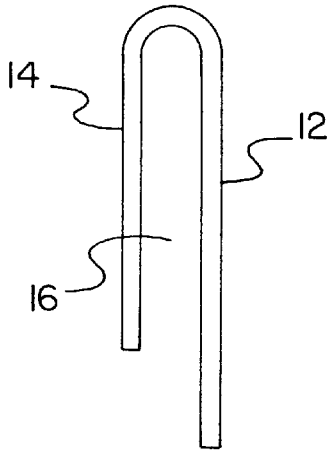
FIG. 4 is a side view of the present invention.

As shown in FIG. 4, the coupling between the front extent and the rear extent has a constant inverted U-shaped vertical cross-section along a length thereof. It is further shown in such Figure that a length of the side edges of each plate is less than that of the front extent. Further, a vertically oriented slot 16 is defined by the extents. As a whole, the present invention has a height of about 2 and ½ inches, a length of about 6 and ¼ inches and a width of about ¾ of an inch.

During use, a pair of doors of an entertainment system cabinet are nearly closed. At this point, the slot defined by the front and rear extent is situated about an interconnection of the doors with the magnets of the doors situated within the space of the present invention which is defined by the plates. Next, the doors are fully closed and are thus prevented from being opened by a small child or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An entertainment cabinet door locking system comprising, in combination:

a pair of doors of an entertainment system cabinet each with a magnet mounted thereon;

a front extent having a planar rectangular configuration with a front face, a rear face, and a periphery formed therebetween, the periphery defined by a long top and bottom edge and a pair of short side edges; and a rear extent including a pair of plates each having a planar square configuration with a periphery defined by a top edge, a bottom edge and a pair of side edges formed therebetween, an area of each plate of the rear extent being about ⅓ that of the front extent, the plates of the rear extent being coupled at the top edges thereof to the top edge of the front extent on opposite sides of the front extent and in parallel relationship therewith to define a slot, whereby a space is situated between the plates of the rear extent;

said coupling between the front extent and the rear extent having a constant U-shaped vertical cross-section along a length thereof;

wherein a length of the side edges of each plate of the rear extent is less than that of the front extent;

wherein the slot releasably receives an interconnection of the doors of the entertainment system cabinet with the magnets situated within the space between the plates of the rear extent.

2. An entertainment cabinet door locking system comprising:

a pair of doors of an entertainment system cabinet each with a magnet mounted thereon;

a front extent having a planar configuration with a front face, a rear face, and a periphery formed therebetween; and a rear extent including at least one plate coupled at a top edge thereof to a top edge of the front extent in parallel relationship therewith to define a slot therebetween, wherein the rear extent includes a pair of plates with a space situated therebetween;

wherein the slot releasably receives an interconnection of the doors of the entertainment system cabinet with the magnets situated within the space between the plates of the rear extent.

3. An entertainment cabinet door locking system as set forth in claim 2 wherein each plate of the rear extent has an area that is about ⅓ that of the front extent.

4. An entertainment cabinet door locking system as set forth in claim 2 wherein a coupling between the front extent and the rear extent has a constant inverted U-shaped vertical cross-section along a length thereof.

* * * * *